US007769331B2

(12) United States Patent
Tsai et al.

(10) Patent No.: US 7,769,331 B2
(45) Date of Patent: Aug. 3, 2010

(54) FUSER ASSEMBLY FOR AN ELECTROPHOTOGRAPHIC DEVICE

(75) Inventors: Cheng-Wen Tsai, Taipei (TW); Chung-Yi Cheng, Taipei (TW); Ming-Chun Hsu, Taipei (TW); I-Chung Hou, Taipei (TW); Yu-Jen Su, Taipei (TW)

(73) Assignee: Lite-On Technology Corp., Taipei (TW)

( * ) Notice: Subject to any disclaimer, the term of this patent is extended or adjusted under 35 U.S.C. 154(b) by 422 days.

(21) Appl. No.: 11/806,188

(22) Filed: May 30, 2007

(65) Prior Publication Data

US 2008/0187370 A1 Aug. 7, 2008

(30) Foreign Application Priority Data

Feb. 2, 2007 (TW) ..... 96103881 A

(51) Int. Cl.
*G03G 15/20* (2006.01)

(52) U.S. Cl. ..... 399/328; 399/122; 399/329

(58) Field of Classification Search ..... 399/122, 399/328, 329, 330, 331
See application file for complete search history.

(56) References Cited

U.S. PATENT DOCUMENTS

| | | | | |
|---|---|---|---|---|
| 5,210,579 | A | 5/1993 | Setoriyama et al. | |
| 5,493,377 | A * | 2/1996 | Nishikawa et al. | 399/328 |
| 6,559,421 | B1 | 5/2003 | Yura et al. | |
| 2005/0185994 | A1 * | 8/2005 | Inada et al. | 399/328 |

FOREIGN PATENT DOCUMENTS

JP 2006251069 9/2006

OTHER PUBLICATIONS

U.S. Appl. No. 11/826,724, filed Feb. 2009, Tsai et al.*

* cited by examiner

*Primary Examiner*—David P Porta
*Assistant Examiner*—Benjamin Schmitt
(74) *Attorney, Agent, or Firm*—Rosenberg, Klein & Lee

(57) ABSTRACT

A fuser assembly for an electrophotographic device includes a tubular roller, a pressing member, a pressing roller, and a heater. The pressing member is disposed in the tubular roller, and includes a tubular part that has a flat surface. The pressing roller presses the tubular roller against the flat surface of the tubular part of the pressing member. The heater is disposed in the tubular part of the pressing member.

8 Claims, 6 Drawing Sheets

FUSER ASSEMBLY FOR AN ELECTROPHOTOGRAPHIC DEVICE

CROSS-REFERENCE TO RELATED APPLICATION

This application claims priority of Taiwanese Application No. 096103881, filed on Feb. 2, 2007.

BACKGROUND OF THE INVENTION

1. Field of the Invention

The invention relates to a fuser assembly, more particularly to a fuser assembly applicable to an electrophotographic device.

2. Description of the Related Art

In U.S. Pat. No. 6,559,421, there is disclosed a conventional fuser assembly for an electrophotographic device that includes a tubular roller, a heater disposed in the tubular roller, and a pressing roller that makes a point contact with the tubular roller.

In operation, when a recording medium with a toner image thereon is fed to the conventional fuser assembly, the toner image on the recording medium is subjected to heat generated by the heater via the tubular roller, by which the toner image is melted, and is subsequently pressed between the tubular roller and the pressing roller, by which the toner image is fixed on the recording medium.

Although the aforementioned conventional fuser assembly achieves its intended purpose, since the pressing roller makes only a point contact with the tubular roller, during operation of the fuser assembly, the toner image on the recording medium makes contact with the tubular roller within only a very short period of time. As such, the recording medium has to be fed very slowly to the conventional fuser assembly. The conventional fuser assembly can, therefore, be very inefficient. Moreover, since the tubular roller is made from a metallic pipe, undesirable curling of the recording medium occurs during operation of the conventional fuser assembly.

A fuser assembly has been proposed in U.S. Pat. No. 5,210,579 to solve the aforementioned problems. The proposed fuser assembly includes a tubular roller that is made from a thin film of polyimide, a support member disposed in the tubular roller, a heater mounted fixedly on the support member, and a pressing roller that presses the tubular roller against the support member and the heater. The proposed fuser assembly, however, is disadvantageous in that, since the heater is mounted fixedly on the support member, when the heater needs replacing, the support member has to be replaced as well.

SUMMARY OF THE INVENTION

Therefore, the main object of the present invention is to provide a fuser assembly that can overcome the aforesaid drawbacks of the prior art.

According to the present invention, a fuser assembly for an electrophotographic device comprises a deformable tubular roller, a heat-conductive pressing member, a pressing roller, and a heater. The pressing member is disposed in the tubular roller, and includes a tubular part that has a flat surface. The pressing roller includes an elastic member that presses the tubular roller against the flat surface of the tubular part of the pressing member. The heater is disposed in the tubular part of the pressing member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
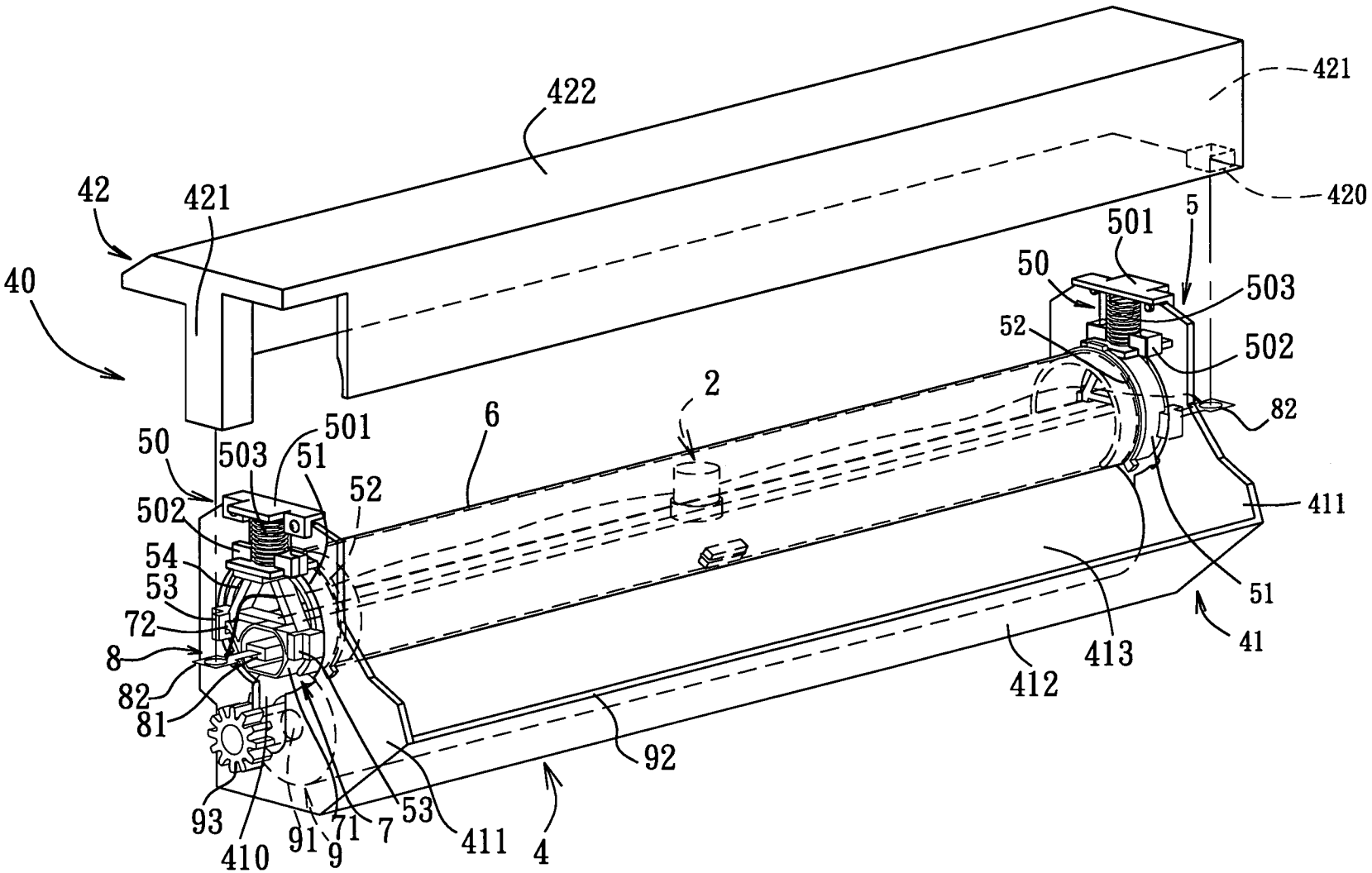
FIG. 1 is a partly exploded perspective view of the preferred embodiment of a fuser assembly according to the present invention.

Referring to FIG. 1, the preferred embodiment of a fuser assembly 40 according to this invention is shown to include a deformable tubular roller 6, a heat-conductive pressing member 7, a pressing roller 9, and a heater 8.

Figure 2:
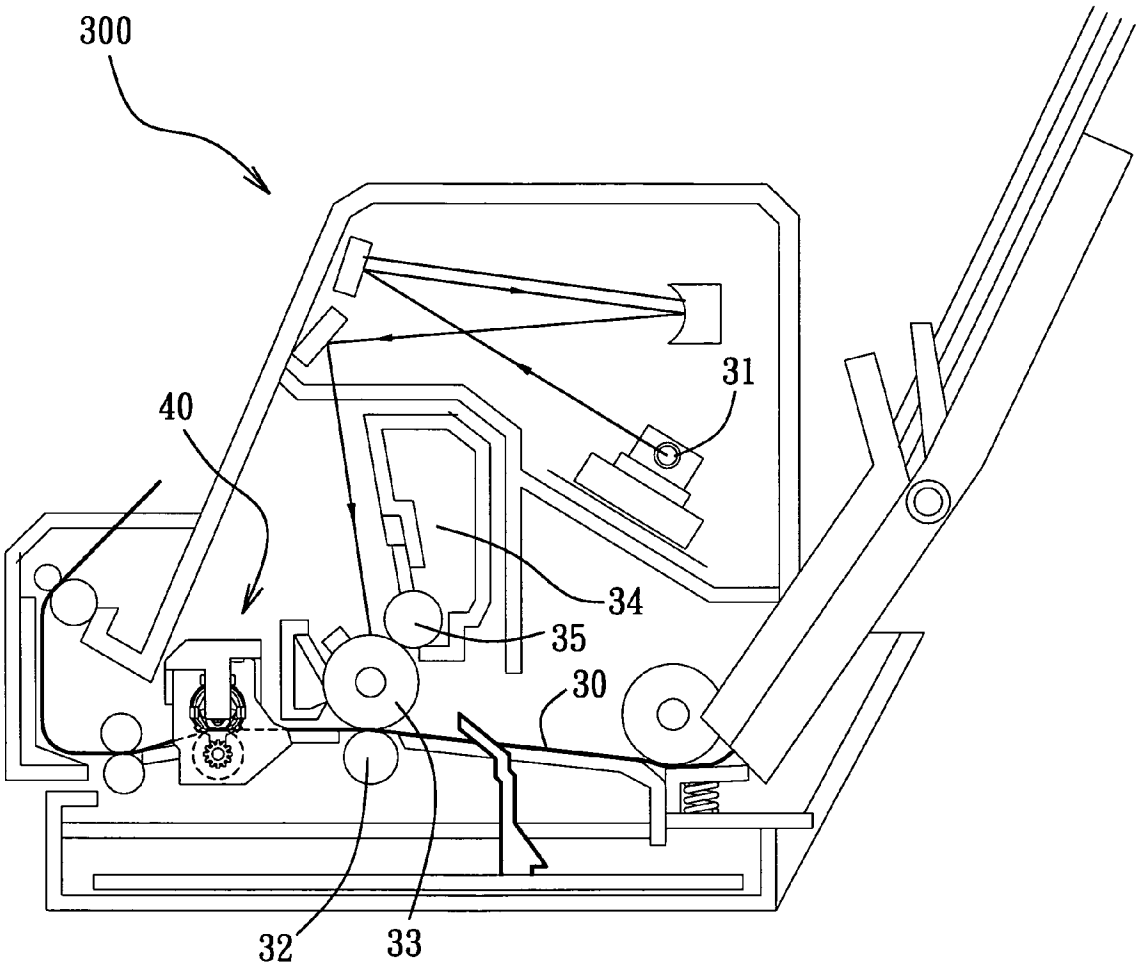
FIG. 2 is a schematic view of the preferred embodiment when installed in an electrophotographic device.

The fuser assembly 40 of this embodiment is applied to an electrophotographic printer 300 (see FIG. 2). In an alternative embodiment, the fuser assembly 40 may be applied to an electrophotographic copier.

With further reference to FIG. 2, the electrophotographic printer 300 includes a light source 31, a photosensitive drum 33, a toner cartridge 34, a developing roller 35, and a transfer roller 32.

When the electrophotographic printer 300 is operated, each of the photosensitive drum 33 and the transfer roller 32 starts to rotate, and a recording medium 30, such as a sheet of paper, is fed between the photosensitive drum 33 and the transfer roller 32. Then, the light source 31, such as a semiconductor laser, irradiates a light beam on the photosensitive drum 33, whereby an electrostatic latent image (not shown) is formed on the photosensitive drum 33. Subsequently, the developing roller 35 electrostatically transfers toner (not shown) from the toner cartridge 34 onto the photosensitive drum 33, whereby a toner image (not shown) is formed on the photosensitive drum 33 which corresponds to the electrostatic latent image on the photosensitive drum 33. As the recording medium 30 is further fed between the photosensitive drum 33 and the transfer roller 32, the toner image is transferred from photosensitive drum 33 onto the recording medium 30. The recording medium 30 is thereafter fed to the fuser assembly 40 for fixing the toner image thereon in a manner that will be described hereinafter.

The fuser assembly 40 further includes a casing 4 that includes upper and lower casing parts 42, 41. The lower casing part 41 of the casing 4 includes left and right walls 411, each of which is formed with a hole 410 therethrough, and a bottom wall 412 that interconnects the left and right walls 411 thereof and that cooperates with the left and right walls 411 to define an accommodating space 413. In this embodiment, the lower casing part 41 is made from metal. The upper casing part 42 of the casing 4 is disposed above the lower casing part 41, and includes left and right walls 421, each of which is provided with an engaging member 420 (only the engaging member 420 of the right wall 421 of the upper casing part 41 is shown in FIG. 1), and a top wall 422 that interconnects the left and right walls 421 thereof. In this embodiment, the upper casing part 42 is made from a plastic material.

The fuser assembly 40 further includes a roller support 5 that includes spaced apart first and second support members 51, each of which is mounted movably on a respective one of the left and right walls 411 of the lower casing part 41 of the casing 4.

Figure 3:
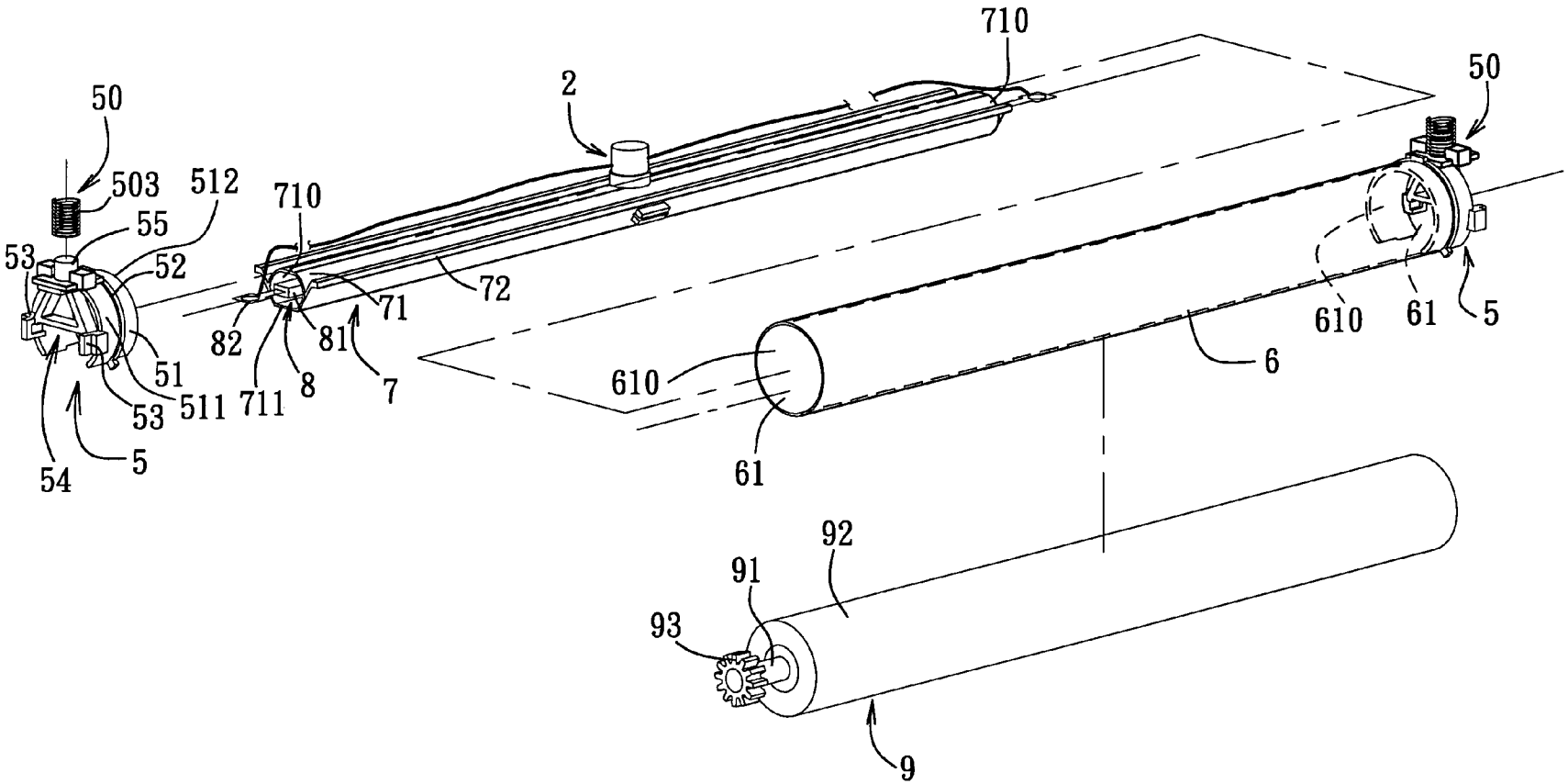
FIG. 3 is an exploded perspective view illustrating a tubular roller, a roller support, a pressing member, a pressing roller, and a heater of the preferred embodiment.

With further reference to FIG. 3, the first support member 51 of the roller support 5 has a C-shaped cross section, and includes a first end portion 511 that is disposed externally of the lower casing part 41 of the casing 4, and a second end portion 512 that extends from the first end portion 511 of the first support member 51 into the accommodating space 413 in the lower casing part 41 of the casing 4 through the hole 410 in the left wall 411 of the lower casing part 41 of the casing 4. In this embodiment, the first support member 51 of the roller support 5 has an outer surface formed with a flange 52, and an inner surface formed with a bracket 54. The flange 52 is disposed in the accommodating space 413 in the lower casing part 41 of the casing 4 and abuts slidably against the left wall 411 of the lower casing part 41 of the casing 4. The bracket 54 is disposed externally of the lower casing part 41 of the casing 4, is triangular in shape, and is provided with a pair of engaging members 53.

Since the construction of the second support member 51 of the roller support 5 is similar to that of the first support member 51 of the roller support 5, a detailed description thereof is omitted herein for the sake of brevity.

Preferably, each of the first and second support members 51 of the roller support 5 is made from a plastic material.

The tubular roller 6 is disposed in the accommodating space 413 in the lower casing part 41 of the casing 4, and has left and right open end portions 61, each of which defines an opening 610 and is sleeved rotatably on the second end portion 512 of a respective one of the first and second support members 51 of the roller support 5 through the opening 610 thereof. In this embodiment, the tubular roller 6 is made from a thin film of polyamide. Preferably, the tubular roller 6 has a wall thickness of 75 μm.

The pressing member 7 is disposed in the tubular roller 6, includes a tubular part 71, and a pair of wings 72. The tubular part 71 of the pressing member 7 has opposite openings 710 and a flat surface 711, and extends through the opening 610 defined by each of the left and right open end portions 61 of the tubular roller 6 and the hole 410 in each of the left and right walls 411 of the lower casing part 41 of the casing 4. Each the wings 72 of the pressing member 7 extends from the tubular part 71 of the pressing member 7 and engages a respective one of the engaging members 53 of the bracket 54 of each of the first and second support members 51 of the roller support 5. In this embodiment, the pressing member 7 is made from an aluminum alloy. Preferably, the tubular part 71 of the pressing member 7 has a wall thickness of 0.7 mm.

Figure 4:
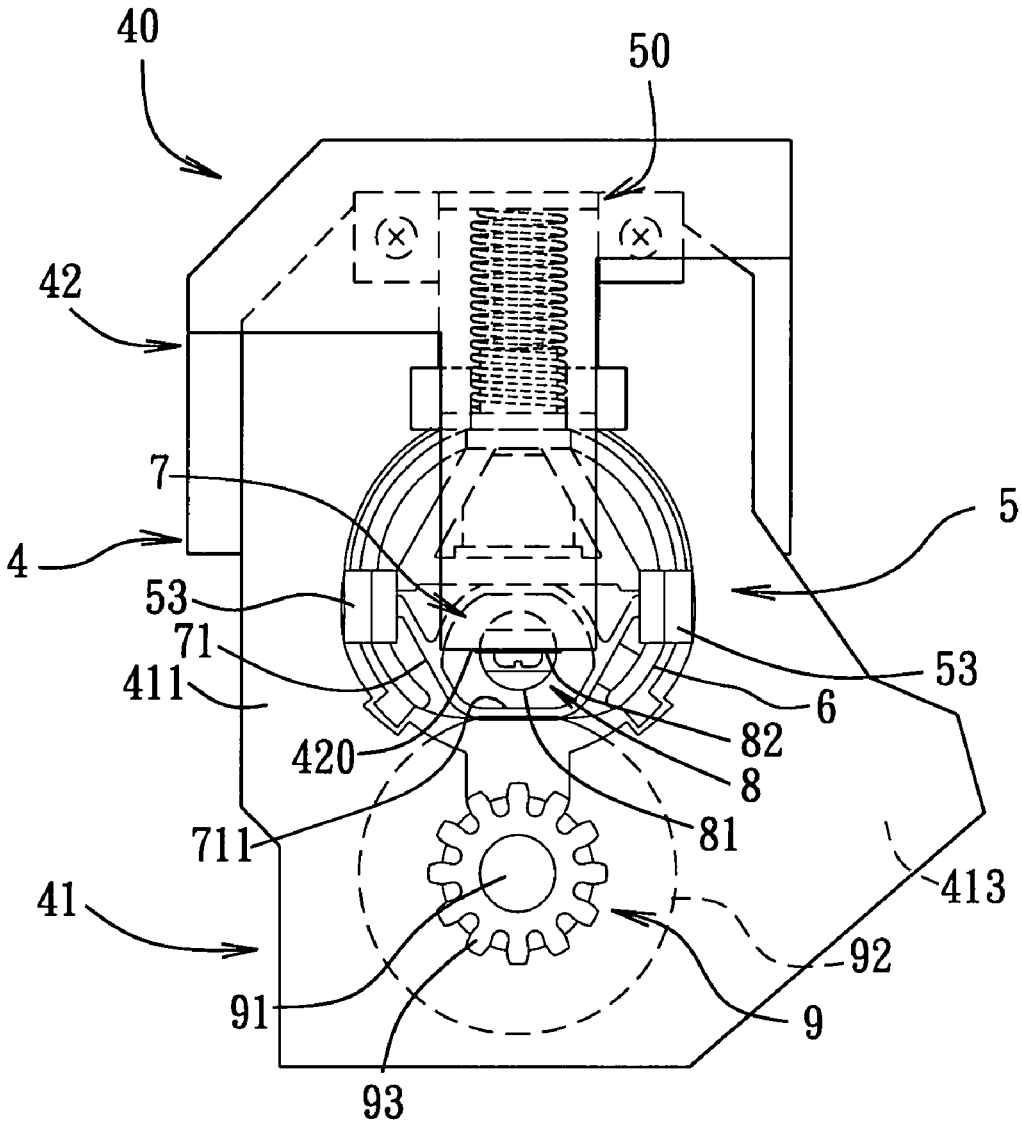
FIG. 4 is a schematic view to illustrate the preferred embodiment in an assembled state.

The pressing roller 9 is mounted rotatably on the casing 4, and includes a shaft 91, an elastic member 92, and a gear 93. The shaft 91 of the pressing roller 9 is disposed in the accommodating space 413 in the lower casing part 41 of the casing 4, and extends rotatably through the hole 410 in each of the left and right walls 411 of the lower casing part 41 of the casing 4. The elastic member 92 of the pressing roller 9 is disposed in the accommodating space 413 in the lower casing part 41 of the casing 4, is wrapped around the shaft 91, and presses the tubular roller 6 against the flat surface 711 of the tubular part 71 of the pressing member 7, as best shown in FIG. 4. The gear 93 of the pressing roller 9 is disposed externally of the lower casing part 41 of the casing 4 and is sleeved securely on the shaft 91.

The electrographic printer 300 further includes a motor (not shown) that is coupled to the gear 93 of the pressing roller 9, and that is operable so as to drive rotation of the pressing roller 9.

The fuser assembly 40 further includes a protective layer 74 (see FIG. 5) provided on the flat surface 711 of the tubular part 71 of the pressing member 7 for reducing a friction coefficient between an inner surface of the tubular roller 6 and the flat surface 711 of the tubular part 71 of the pressing member 7 to less than that between an outer surface of the tubular roller 6 and the recording medium 30. In this embodiment, the protective layer 74 is made from a resin material. Preferably, the protective layer 74 has a thickness of 15 μm.

The fuser assembly 40 further includes a biasing unit 50 that serves to bias the tubular roller 6 against the pressing roller 9. In particular, the outer surface of each of the first and second support members 51 of the roller support 5 is further formed with a protrusion 55 that is disposed externally of the lower casing part 41 of the casing 4. The biasing unit 50 includes first and second abutting members 501, third and fourth abutting members 502, and first and second biasing members 503. Each of the first and second abutting members 501 is fastened on the respective one of the left and right walls 411 of the lower casing part 41 of the casing 4. Each of the third and fourth abutting members 502 is sleeved on the protrusion 54 of the respective one of the first and second support members 51 of the roller support 5 and abuts against the outer surface of the respective one of the first and second support members 51 of the roller support 5. The first biasing member 503 is sleeved on the protrusion 54 of the first support member 51 of the roller support 5, and has opposite ends that abut respectively against the first and third abutting members 501, 502. The second biasing member 503 is sleeved on the protrusion 54 of the second support member 51 of the roller support 5, and has opposite ends that abut respectively against the second and fourth abutting members 501, 502. In this embodiment, each of the first and second biasing members 503 of the biasing unit 50 is a compression spring.

The heater 8 is disposed in the tubular part 71 of the pressing member 7 and is separated from the pressing member 7, and includes a heat-generating element 81 and a pair of electrodes 82. The heat-generating element 81 of the heater 8 is disposed in the tubular roller 6, and has left and right end portions. Each of the electrodes 82 extends from a respective one of the left and right end portions of the heat-generating element 81, through a respective one of openings 710 of the tubular part 71 of the pressing member 7 and the opening 610 defined by the respective one of the left and right open end portions 61 of the tubular roller 6, and further through the bracket 54 of the respective one of the first and second support members 51 of the roller support 5. Each of the electrodes 82 is additionally coupled to a power source (not shown), and engages releasably the engaging member 420 of a respective one of the left and right walls 421 of the upper casing part 42 of the casing 4, thereby mounting removably the heater 8 on the casing 4. As such, the heater 8 can be solely replaced. In this embodiment, the heater 8 is a halogen heater. In an alternative embodiment, the heater 8 is a resistor.

Figure 5:
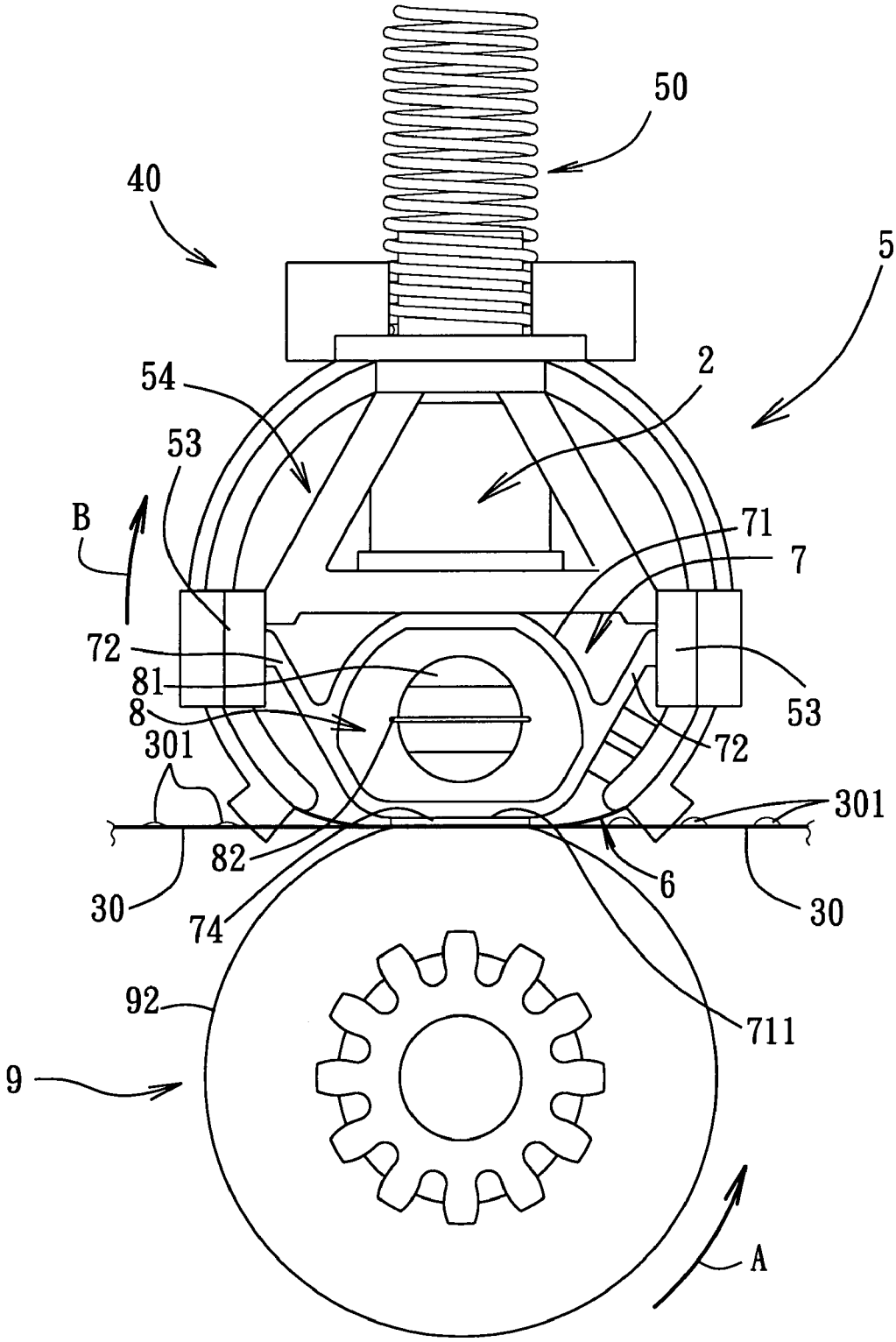
FIG. 5 is a fragmentary schematic view to illustrate operation of the preferred embodiment.

In operation, referring to FIG. 5, when the recording medium 30 is fed to the fuser assembly 40 of this invention, the pressing roller 9 rotates in a counter-clockwise direction, as indicated by arrow (A), and drives rotation of the tubular roller 6 in a clockwise direction, as indicated by arrow (B). As the recording medium 30 is further fed to the fuser assembly 40 of this invention, the toner image 301 on the recording medium 30 is subjected to heat generated by the heat-generating element 81 of the heater 8 via the tubular part 71 of the pressing member 7 and the tubular roller 6, by which the toner image 301 is melted, and is subsequently pressed between the tubular roller 6 and the elastic member 92 of the pressing roller 9, by which the toner image 301 is fixed on the recording medium 30.

From the above description, since the tubular roller 6 is pressed on the flat surface 711 of the tubular part 71 of the pressing member 7 by the pressing roller 9, during the operation of the fuser assembly 40 of this invention, not only is undesirable curling of the recording medium 30 prevented, but the toner image 301 on the recording medium 30 makes contact with the tubular roller 6 for a relatively longer period of time. As such, the recording medium 30 may be fed very quickly to the fuser assembly 40 of this invention. The fuser assembly 40 of this invention can, therefore, be applied to an electrographic printer with a fast printing speed. Moreover, since the friction coefficient between the inner surface of the tubular roller 6 and the flat surface 711 of the tubular part 71 of the pressing member 7 is less than that of between the outer surface of the tubular roller 6 and the recording medium 30, slippage between the recording medium 30 and the tubular roller 6 is prevented during the operation of the fuser assembly 40 of this invention.

It is noted herein that the outer surface of the tubular roller 6 may be coated with a tetrafluoroethylene perfluoroalkylvinylether copolymer resin (PFA) for preventing the toner image 301 from adhering thereon.

The fuser assembly 40 further includes a heater controller 2 (see FIG. 1) that is disposed in the accommodating space 413 in the lower casing part 41 of the casing 4, that is coupled to the electrodes 82 of the heater 8, and that is operable so as to maintain the heater 8 within a predetermined temperature range.

Figure 6:
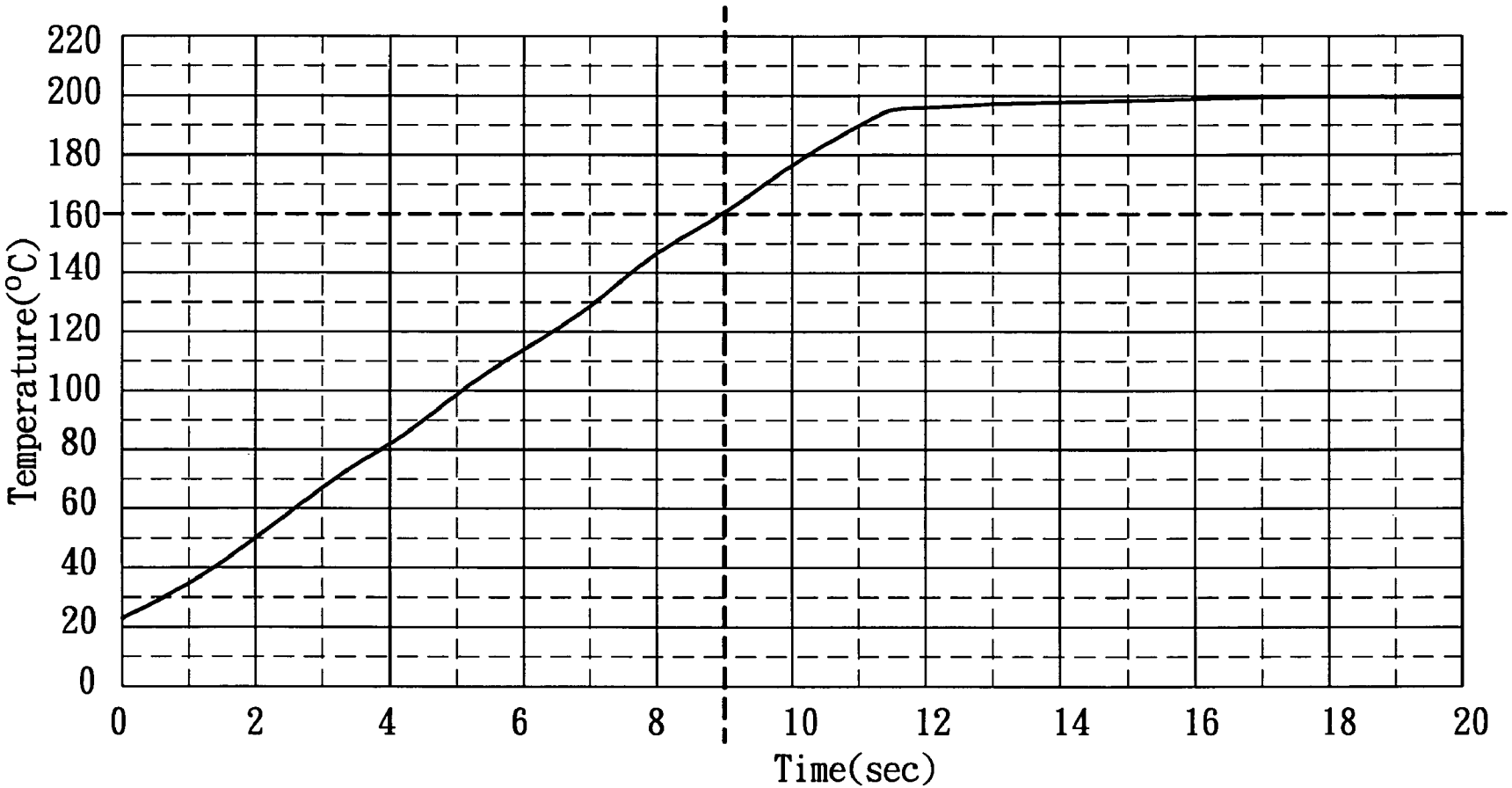
FIG. 6 is a plot to illustrate a warm-up time of the preferred embodiment.

Based on experimental results and with reference to FIG. 6, since the heat generated by the heater 8 is applied on the tubular roller 6 via the tubular part 71 of the pressing member 7, a warm-up time of the tubular roller 6 from a temperature of approximately 20° C. (i.e., room temperature) to an operating temperature of 160° C. is reduced to nine seconds. The tubular roller 9 of the fuser assembly 40 of this invention, therefore, has a relatively short warm-up time.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A fuser assembly for an electrophotographic device, comprising:

a casing;

a deformable tubular roller disposed in said casing;

a heat-conductive pressing member disposed in said tubular roller, and inducing a tubular part that has a flat surface and opposing open ends;

a pressing roller disposed in said casing and in contiguous contact with said tubular roller;

a heater disposed in said tubular part of said pressing member; and a roller support including:

first and second support members disposed in spaced relationship one from the other, each of said first and second support members being mounted movably on said casing, said tubular roller having a pair of opposing open end portions, each of said end portions being sleeved rotatably on a respective one of said first and second support members and defines an opening, said tubular part of said pressing member having front and rear ends, and extending through said opening defined by each of said open end portions of said tubular roller, said pressing member further including a pair of wing portions that extend outwardly and respectively from said front and rear ends of said tubular part thereof and engage said first and second support members on opposing sides thereof, and a biasing unit for biasing said tubular roller against said pressing roller, said tubular roller being biased against said flat surface of said tubular part of said pressing member, said biasing unit including first and second abutting members, said first and second abutting members being disposed on said casing, a first biasing member being disposed between said first support member and said first abutting member, and a second biasing member being disposed between said second support member and said second abutting member;

wherein said casing has a pair of opposing end walls, end wall having in respective engaging member disposed thereon; and said heater having opposing ends releasably engaged with a corresponding one of said engaging members, whereby said heater is replaceable independently of said pressing member and said tubular roller.

2. The fuser assembly as claimed in claim 1, wherein said heater includes:

a heat-generating element that is disposed in said tubular part of said pressing member, and a pair of electrodes, each of which extends from said heat-generating element through a respective one of said open ends of said tubular part of said pressing member and through a respective one of said open end portions of said tubular roller, and each of said electrodes being mounted removably on said casing, said electrodes respectively forming said opposing ends of said heater.

3. The fuser assembly as claimed in claim 1, wherein each of said first and second support members of said roller support has a C-shaped cross-section, and is provided with a bracket, said wings of said pressing member engaging said bracket of each of said first and second support members of said roller support.

4. The fuser assembly as claimed in claim 3, wherein said bracket of each of said first and second support members of said roller support is provided with an engaging member, said wings of said pressing member engaging said engaging member of said bracket of each of said first and second support members of said roller support.

5. The fuser assembly as claimed in claim 1, further comprising a heater controller coupled to said heater and operable so as to maintain said heater within a predetermined temperature range.

6. The fuser assembly as claimed in claim 1, further comprising a protective layer provided on said flat surface of said tubular part of said pressing member for reducing a friction coefficient between said tubular roller and said flat surface of said tubular part of said pressing member.

7. The fuser assembly as claimed in claim 1, wherein said pressing member is made from an aluminum alloy.

8. The fuser assembly as claimed in claim 1, wherein said tubular roller is made from a thin film of polyimide.

* * * * *